United States Patent [19]

Gaule et al.

[11] Patent Number: 4,518,030

[45] Date of Patent: May 21, 1985

[54] MULTI-TURN COILS OF CONTROLLED PITCH FOR ELECTROMAGNETIC CASTING

[75] Inventors: Gerhart K. Gaule, Elberon, N.J.; John C. Yarwood, Madison; Derek E. Tyler, Cheshire, both of Conn.

[73] Assignee: Olin Corporation, New Haven, Conn.

[21] Appl. No.: 391,631

[22] Filed: Jun. 24, 1982

Related U.S. Application Data

[63] Continuation of Ser. No. 193,852, Oct. 3, 1980, abandoned, which is a continuation of Ser. No. 009,429, Feb. 5, 1979, abandoned.

[51] Int. Cl.[3] ..... B22D 27/02

[52] U.S. Cl. ..... 164/503

[58] Field of Search ..... 164/467, 468, 503, 504

[56] References Cited

U.S. PATENT DOCUMENTS 3,985,179 10/1976 Goodrich et al. ..... 164/467

3,995,678 12/1976 Zavaras ..... 164/468

*Primary Examiner*—Kuang Y. Lin

*Attorney, Agent, or Firm*—Howard M. Cohn; Barry L. Kelmachter; Paul Weinstein

[57] ABSTRACT

An apparatus and process for casting metals wherein the molten metal is contained and formed into a desired shape by the application of an electromagnetic field produced by a multi-turn inductor. The pitch or spacing of individual turns of the inductor is controlled to provide accurately varied electromagnetic pressure. The process includes the step of varying the distance between turns and/or the height of the individual turns to control the electromagnetic forces and balance the metallostatic pressure within the molten metal being cast.

12 Claims, 8 Drawing Figures

MULTI-TURN COILS OF CONTROLLED PITCH FOR ELECTROMAGNETIC CASTING

This application is a continuation of U.S. application Ser. No. 193,852, filed Oct. 3, 1980, by Gerhart K. Gaule et al. for MULTI-TURN COILS OF CONTROLLED PITCH FOR ELECTROMAGNETIC CASTING, now abandoned, which in turn is a continuation of U.S. application Ser. No. 9,429, filed Feb. 5, 1979, by Gerhart K. Gaule et al., for MULTI-TURN COILS OF CONTROLLED PITCH FOR ELECTROMAGNETIC CASTING, now abandoned.

BACKGROUND OF THE INVENTION

This invention relates to an improved process and apparatus for electromagnetically casting metal and metal alloys, particularly high melting point metals and alloys. Electromagnetic casting processes have been known and used for many years for continuously and semi-continuously casting metals and alloys.

PRIOR ART STATEMENT

Known prior art electromagnetic casting apparatus comprises a three part mold consisting of a water cooled inductor, a non-magnetic screen and a manifold for applying cooling water to the ingot. Such an apparatus is exemplified in U.S. Pat. No. 3,466,166 to Getselev et al. Containment of the molten metal is achieved without direct contact between the molten metal and any component of the mold. Solidification of the molten metal is achieved by direct application of the water from the cooling manifold to the ingot shell.

The cooling manifold may direct the water against the ingot from above, from within, or from below the inductor, as exemplified in U.S. Pat. Nos. 3,735,799 to Karlson, and 3,646,988 to Getselev. In some prior art approaches the inductor is formed as part of the cooling manifold so that the cooling manifold supplies both coolant to solidify the casting and to cool the inductor as exemplified in U.S. Pat. Nos. 3,773,101 to Getselev and 4,004,631 to Goodrich et al. The water cooled inductor of Goodrich et al. 631' is provided with a preferential geometry.

During electromagnetic casting of molten metal the radial component of the electromagnetic pressure against a molten metal column generally must be equal to the hydrostatic pressure of the molten metal being shaped. To compensate for the gradually low hydrostatic pressure of the molten metal progressing toward the upper portion thereof, it is known to provide an electromagnetic shield or screen positioned between the inductor and the top of the molten metal column to attenuate the electromagnetic field generated by the inductor and thereby gradually reduce the radial forces acting on the molten metal toward the top of the column.

Prior art non-magnetic screens have been utilized to properly shape the magnetic field for containing the molten metal as exemplified in U.S. Pat. No. 3,605,865 to Getselev. A variety of approaches with respect to non-magnetic screens are exemplified as well in the Karlson 799' Patent and in U.S. Pat. No. 3,985,179 to Goodrich et al. Goodrich et al. 179' describes the use of a shaped inductor to shape the field, without the use of a non-magnetic screen. Similarly, a variety of inductor designs are set forth in the aforenoted patents and in U.S. Pat. No. 3,741,280 to Kozheurov et al.

While the above-described patents disclose the electromagnetic casting molds for casting a single strand or ingot at a time, the process can be applied to the casting of more than one strand or ingot simultaneously, as exemplified in U.S. Pat. No. 3,702,155. In addition to the aforenoted patents a further description of the electromagnetic casting process can be found by reference to the following articles: "Continuous Casting with Formation of Ingot by Electromagnetic Field", by P. P. Mochalov and Z. N. Getselev, *Tsvetnye Met.,* August, 1970, 43, pp. 62–63; "Formation of Ingot Surface During Continuous Casting", by G. A. Balakhonpsev et al., *Tsvetnye Met.,* August, 1970, 43, pp. 64–65; "Casting in an Electromagnetic Field", by Z. N. Getselev, *J. of Metals,* October, 1971, pp. 38–59; "Alusuisse Experience with Electromagnetic Molds", by H. A. Meier, G. B. Laeconte, and A. M. Odok, *Light Metals,* 1977, pp. 223–233.

When one attempts to employ the electromagnetic casting process for casting heavier metals than aluminum, such as copper, copper alloys, steel alloys, steel, nickel, nickel alloys, etc. various problems arise in controlling the casting process. In the electromagnetic casting process the molten metal head is contained and held away from the mold walls by an electromagnetic pressure which counter balances the hydrostatic pressure of the molten metal head. The hydrostatic pressure of the molten metal head is a function of the molten metal head height and the specific gravity of the molten metal.

When casting aluminum and aluminum alloys using the electromagnetic casting method, the molten metal head has a comparitively low density with a high surface tension due to the oxide film formed on its surface. The surface tension is additive to the electromagnetic pressure and both act against the hydrostatic pressure of the molten metal head. A small fluctuation in the molten metal head therefore gives rise to a small difference in the magnetic pressure required for containment. For heavier metals and alloys, such as copper and copper alloys, comparable changes in the molten metal head cause a greater change in hydrostatic pressure and in the required offsetting magnetic pressure. In addition copper and copper alloys display surface tensions considerably lower than seen in aluminum alloys. This effect in turn requires further compensating increases in magnetic pressure. It has been found for copper and copper alloys that the change in magnetic pressure required for containment, is approximately three times greater than for aluminum and aluminum alloys with comparable changes in molten metal head.

In order to obtain an ingot of uniform cross-section over its full length the periphery of the ingot and molten metal head within the inductor must remain vertical especially near the liquid solid interface of the solidifying ingot shell. The actual location of the periphery of the ingot is the plane over which the hydrostatic and magnetic pressures balance. Therefore, any variations in the absolute molten metal head height cause comparable variations in hydrostatic pressure which produce surface undulations alongs the length of the ingot. Those surface undulations are very undesirable and can cause reduced metal recovery during further processing.

Use of multi-turn inductors is shown in U.S. Pat. No. 3,995,678 to Zavaras et al. and U.S. Pat. No. 3,857,696 to Aldersley et al. The Patent to Zavaras 678' shows a multi-turn inductor placed about a continuously formed ingot after it emerges from a forming mold to stir the molten interior of the solidifying ingot, while the multi-turn inductor of the Patent to Aldersley et al. is utilized to prevent molten metal splash-over.

SUMMARY OF THE INVENTION

This invention relates to a process and apparatus for casting metals wherein the molten metal is contained and formed into a desired shape by the application of an electromagnetic field. In particular, an inductor is used to apply a magnetic field to the molten metal. The field itself is created by applying an alternating current to the inductor. In operation, the inductor is spaced from the molten metal by a gap which extends from the surface of the molten metal to the opposing surface of the inductor.

In accordance with this invention an improved process and apparatus is provided wherein a variable-pitch multi-turn inductor is utilized to minimize the variations in the gap during operation of the casting apparatus. The variable-pitch multi-turn inductor comprises a coil or individual turns wherein the spacing of the individual turns or the pitch of the coil is controlled so as to provide electromagnetic pressure which accurately counter balances the metallostatic pressure within the molten metal being contained while maintaining substantially vertical sidewalls.

Accordingly, it is an object of this invention to provide an improved process and apparatus for electromagnetically casting metals and alloys.

It is a further object of this invention to provide a process and apparatus as above wherein the pitch of an inductor coil is determined and set so as to provide the desired electromagnetic pressure.

It is a still further object of this invention to provide a process and apparatus as above wherein the spacing of individual turns of an inductor is carefully determined and set so as to provide the desired electromagnetic pressure.

It is a still further object of this invention to provide a process and apparatus as above wherein the height of individual turns of an inductor is controlled so as to provide desired electromagnetic pressure.

It is a still further object of this invention to provide a process and apparatus as above wherein an electromagnetically cast ingot is produced which is substantially free of surface undulations.

It is a still further object of this invention to provide a variable-pitch multi-turn inductor for electromagnetic casting which provides very good electrical coupling between a power generator and the contained metal.

These and other objects will become more apparent from the following description and drawings.

DETAILED DESCRIPTION OF THE PREFERRED EMBODIMENTS

Figure 1:
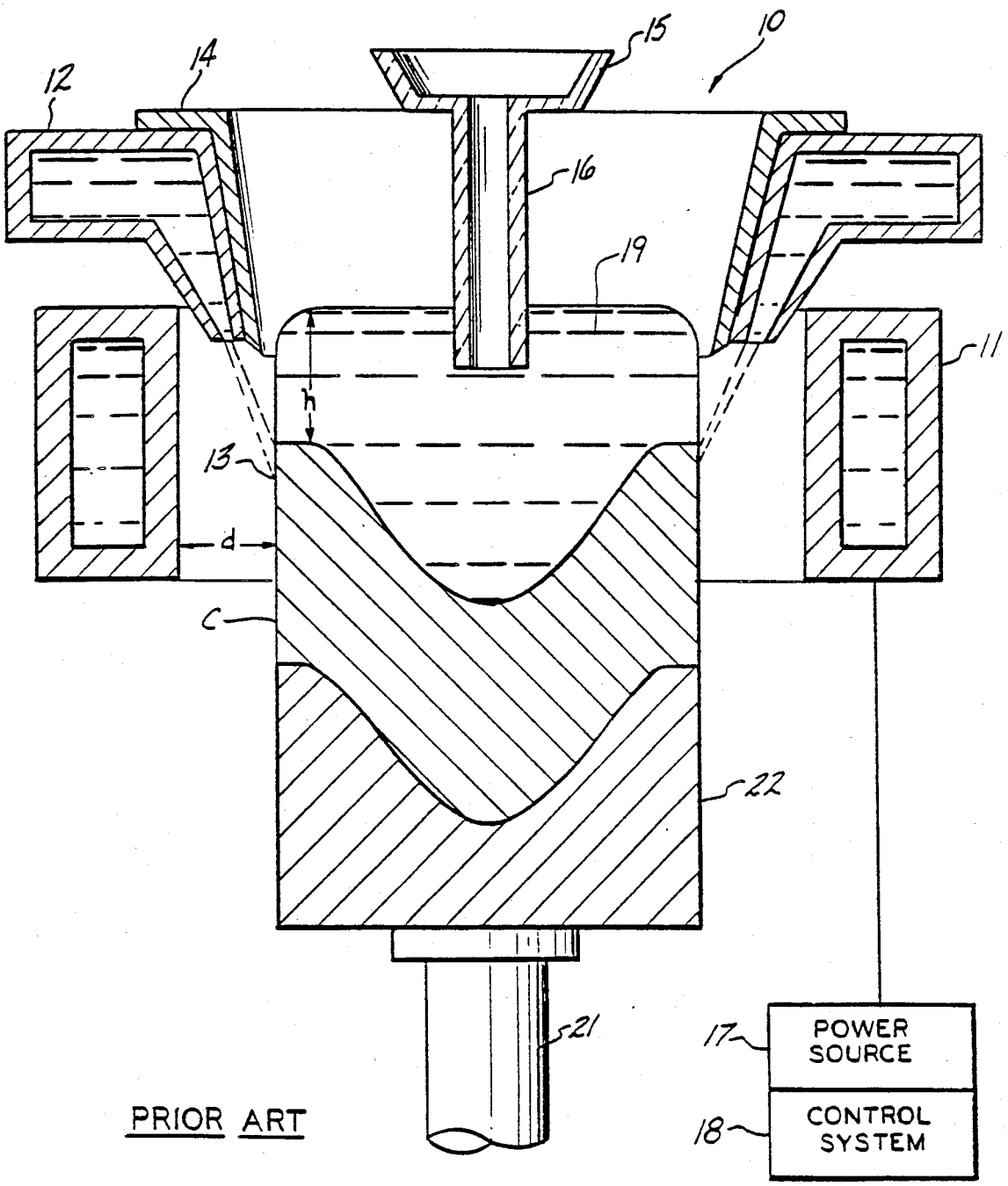
PRIOR ART FIG-1
FIG. 1 is a schematic representation of a prior art electromagnetic casting apparatus consisting in part of a single-turn inductor.

Referring now to FIG. 1 there is shown therein a prior art casting apparatus consisting in part of a single-turn inductor. The electromagnetic casting mold 10 is comprised of a single-turn inductor 11 which is water cooled; a cooling manifold 12 for applying cooling water to the peripheral surface 13 of the metal being cast; and a nonmagnetic screen 14. Molten metal is continuously introduced into the mold 10 during a casting run using a trough 15 and a downspout 16, with the initial surge of molten metal contacting bottom block 22 in a raised position after which bottom block 22 is withdrawn by ram 21. The inductor 11 is excited by an alternating current from a power source 17 and control system 18. The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross-section. An air gap d exists during casting, between the molten metal head 19 and the inductor 11. The molten metal head 19 is formed or molded into the same general shape as the inductor 11 thereby providing the desired ingot cross-section. The inductor may have any desired shape including circular or rectangular as required to obtain the desired ingot cross-section. The purpose of the non-magnetic screen 14 is to fine tune and balance the magnetic pressure with the hydrostatic pressure of the molten metal head 19.

Figure 2:
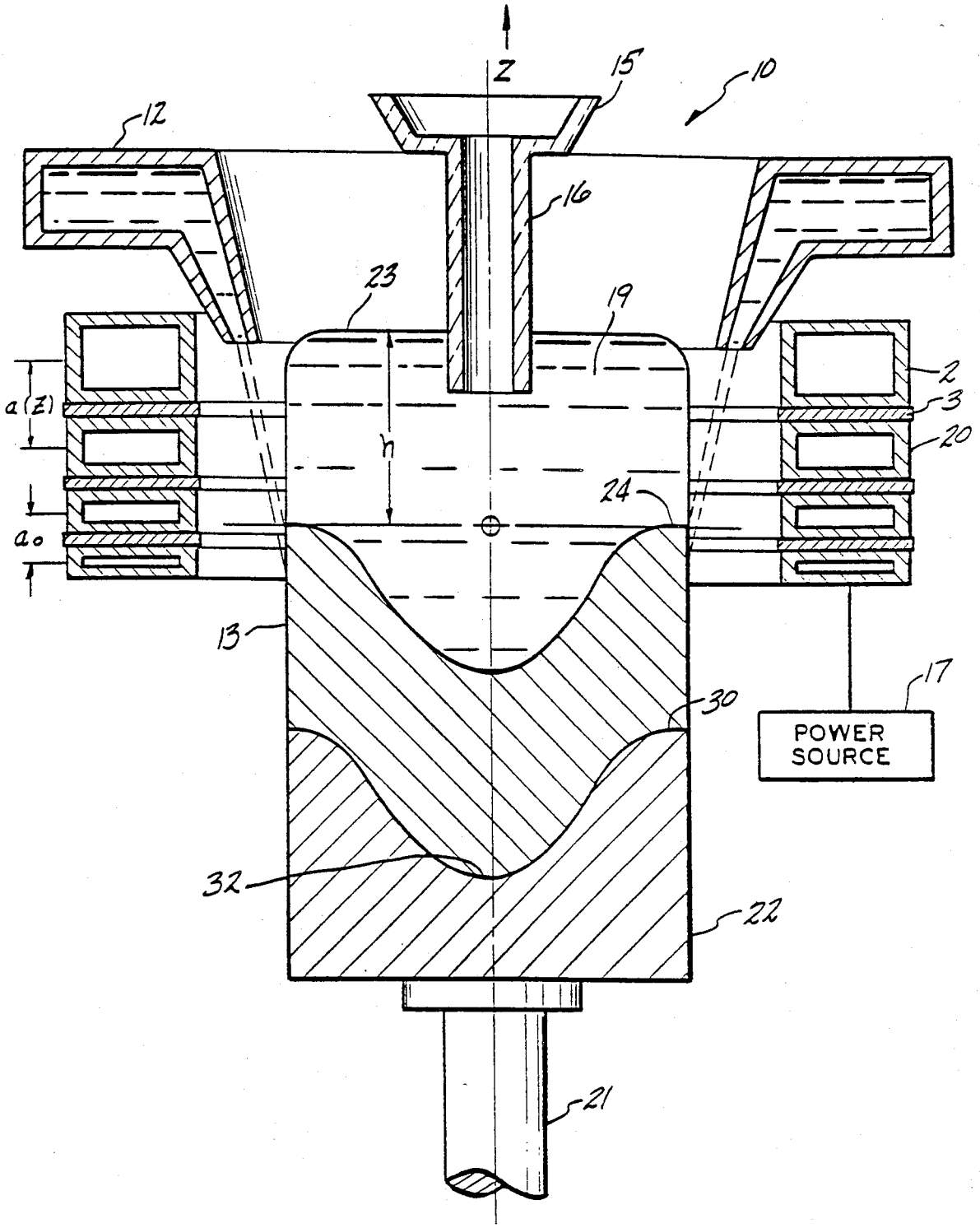
FIG. 2 is a schematic representation of an electromagnetic casting apparatus in accordance with the present invention, showing a variable-pitch stacked inductor.

Referring to FIG. 2, in accordance with this invention, single-turn prior art inductor 11 and non-magnetic screen 14 have been replaced by variable-pitch multi-turn inductor 20 of this invention.

The pitch, for purposes of this invention, is defined as the distance between corresponding points each located on the center-line (mid-point of the height) on two adjacent turns of the variable-pitch multi-turn inductor 20. See $a_o$ and a(z) in FIGS. 2 and 3.

The pitch or spacing between turns of variable-pitch multi-turn inductor 20 can be determined according to the equation:

$$a(z) = ao/\sqrt{\frac{h-z}{h}}$$

wherein a(z)=the pitch or spacing between inductor turns at a height z above the solidification interface a(o)=the pitch or spacing between inductor turns at the solidification interface h=the total molten metal head z=the height above the solidification interface.

It can be seen that the minimum spacing $a_o$ between adjacent turns should be located nearest to the solidification interface of the ingot being cast so that the maximum ampere turns per the unit height counter balances the maximum metallostatic pressure $p_o$ which occurs at that point. Above that point, the inter-turn spacing a(z) of the inductor is increased as the metallostatic pressure p within the molten metal decreases as given in the above equation.

The electromagnetic field generated by the upper portions of the electromagnetic inductor of this invention has a gradually diminishing flux density so that the radial forces on the molten metal surface are gradually reduced towards the upper portion of the molten metal head to maintain the vertical surfaces of the molten metal essentially straight and free of surface undulations. This generation of diminishing electromagnetic field, the flux density of which diminishes in a vertical direction towards the top of the inductor, is effected by virtue of the use of multi-turn inductor pitch control.

Figure 4:
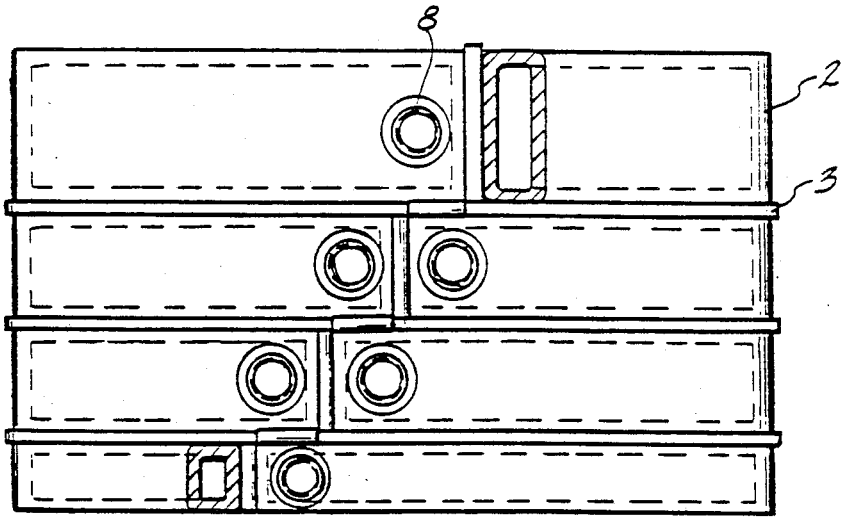
FIGS. 4 and 5 are different side views of the variable-pitch stacked inductor of FIG. 2.
Figure 5:
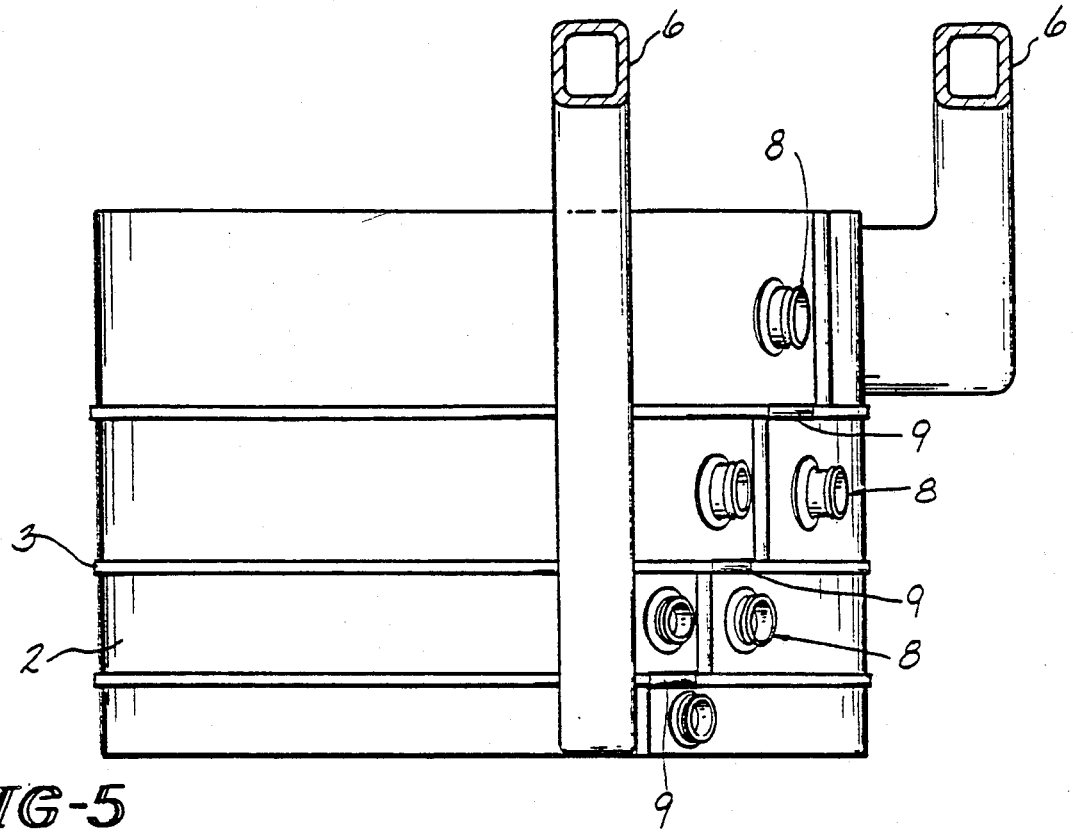
Figure 6:
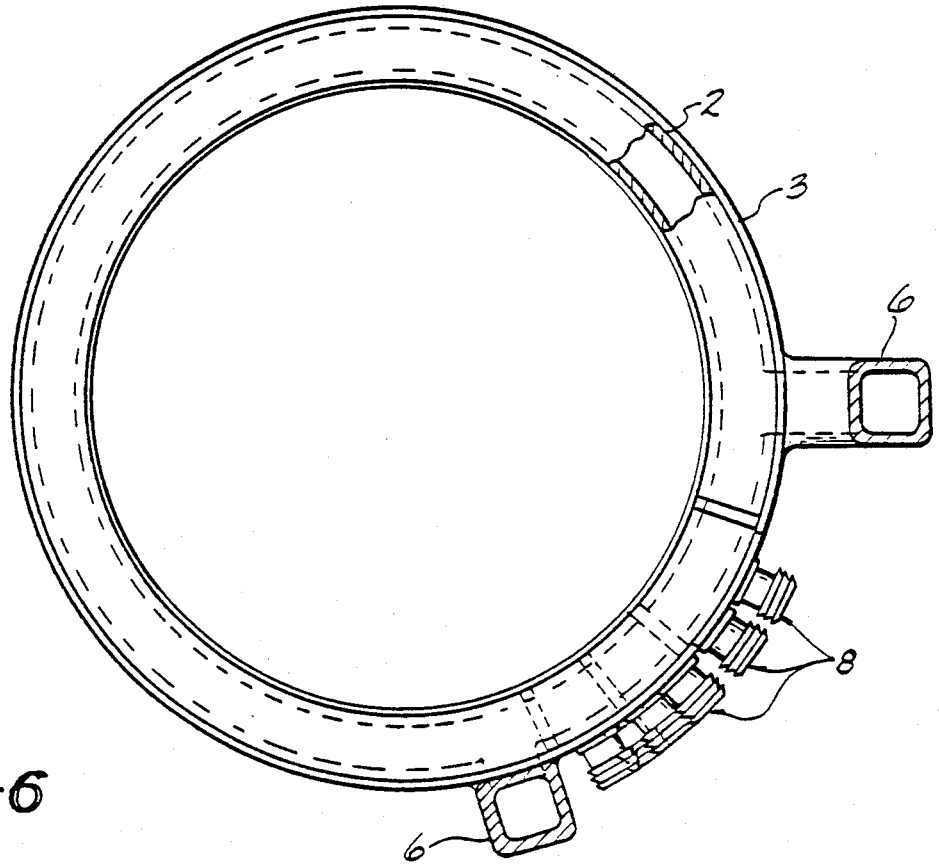
FIG. 6 is a top view of the variable-pitch stacked inductor of FIG. 5.

The variable-pitch stacked inductor 20 of FIG. 2 is further shown in FIGS. 4 through 6. As can be seen from these figures variable-pitch stacked inductor 20 is constructed of multiple turns 2 of different cross-section which are equally spaced by insulating spacers 3. Inductor turns 2 are provided with through passges 7 for cooling fluid such as water. Hose nipples 8 are provided on each turn 2 to permit ready attachment to a cooling fluid supply source. The cross-sectional height of turns 2 increases from the bottom to the top of variable-pitch multi-turn inductor 20 to effect a decreasing magnetic field in the upward direction.

Electrical connection to a power source is provided by bus connections 6. The individual turns of multi-turn inductor 20 are shown to be connected in series but water cooling can be in series or parallel as desired. Electrical series connections 9 can consist of for example silver braze, with an optional copper spacer if necessary. Insulator spacers 3 are constructed of insulating material, preferably of a thermo-setting high temperature plastic such as fiberglass reinforced phenolic, or fiberglass reinforced silicone. Turns 2 are preferably constructed of rectangular section copper tube, but could be constructed of other materials and cross-sections.

Figure 7:
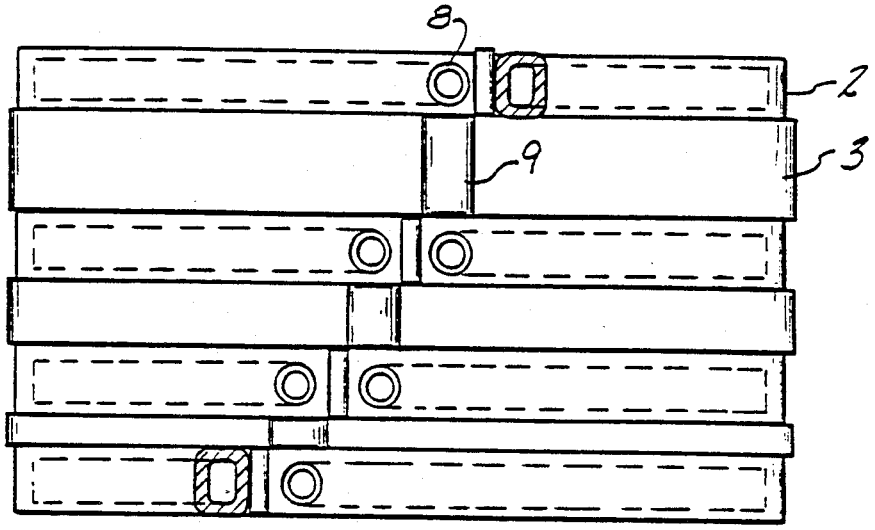
FIG. 7 is a side view of a variable-pitch stacked inductor embodiment of the present invention showing unequal spacing between each turn of the inductor.
Figure 8:
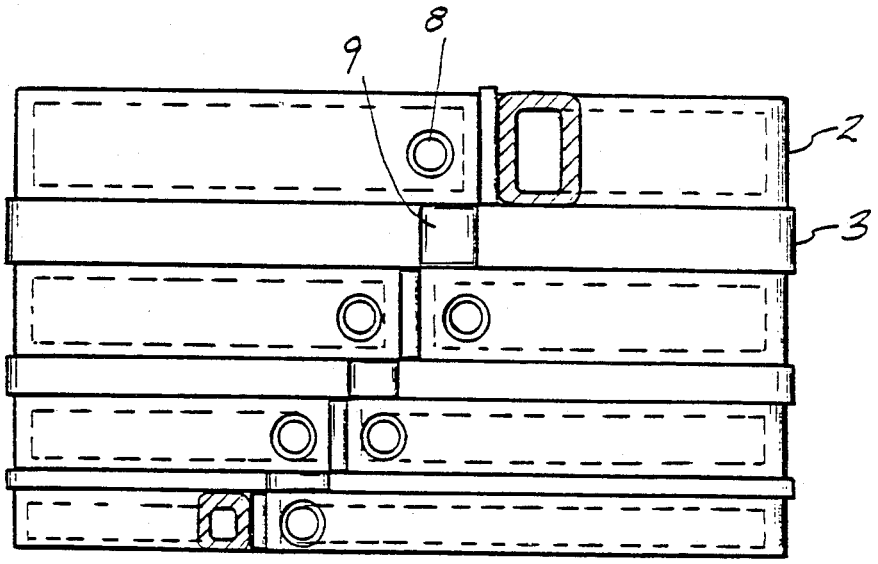
FIG. 8 is a side view of a variable-pitch stacked inductor embodiment of the present invention showing a variation in the spacing between and in the height of turns of the inductor.

FIGS. 7 and 8 show two further embodiments of the stacked inductor of this invention. In FIG. 7 a decreasing magnetic field in the upper direction is provided by utilizing equal cross-section turns while varying the height of insulator spacers 3. In order to obtain reduced magnetic fields towards the top of the inductor 20 the height of spacers 3 in an upper direction. In accordance with FIG. 8, both the spacers 3 and the cross-section of copper turns 2 could be varied. Again the spacers and the turn cross-sections are of increased height in the upper direction so as to effect a decreasing magnetic field as one goes from the bottom to the top of multi-turn inductor 20. In both cases, the net effect is to vary, in a known way, the current per unit of coil height or amperes per inch, in order to vary the resulting magnetic field strength.

Figure 3:
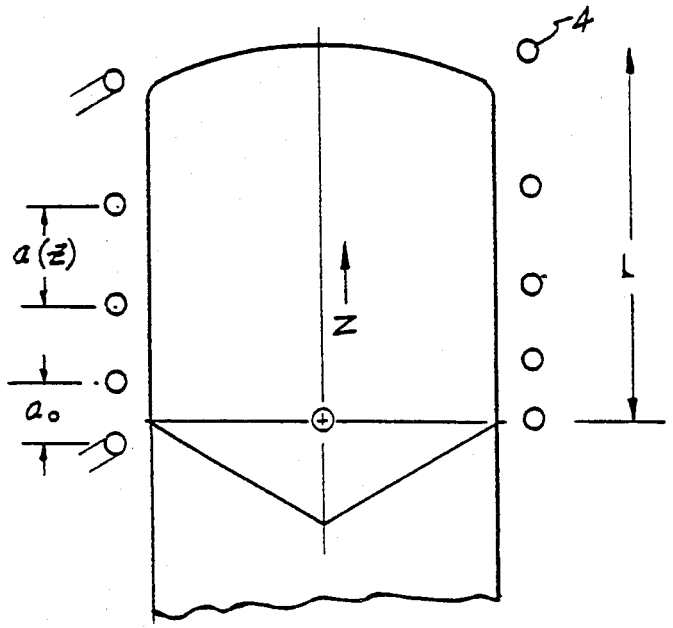
FIG. 3 is a schematic representation of a variable-pitch multi-turn inductor in accordance with the present invention.

FIG. 3 represents a further embodiment of this invention wherein a variable-pitch multi-turn coil 4 is utilized as in inductor to provide the desired magnetic field. Variable-pitch multi-turn coil 4 is preferably constructed of copper tube of round cross-section, but can be constructed of other materials and cross-sections, such as, for example, rectangular tube or solid coil. Coil 4 can be provided with an internal passage for cooling fluid or can be cooled externally.

The high impedance circuit of the present invention negates the need for a transformer interposed between the power source and the inductor which is necessary with prior art inductors. Moreover, the inductor of this invention provides an accurate definition of current density. Since full current passes through each turn of the coil, the inductor of the present invention provides a means for accurately defining the current density over the full height of the inductor. In addition, the current density provided by the inductor of this invention is a function of the turn spacing or pitch of the coil only, and is not influenced by the shape of the molten metal being contained as it is in the case of massaive single-turn inductors.

Another advantage of this invention lies in the fact that the use of the inductor of this invention permits a smaller air gap d than that associated with the prior art. By virtue of the use of the pitch control of this invention rather than shape or spreading control and/or electromagnetic shields as in single-turn inductors, a reduction in air gap and consequent reduction in inductance of the circuit results in the realizing of substantial power savings.

Finally, a further advantage of the variable-pitch multi-turn inductor of this invention is that the connecting points to the power circuit are so positioned as to minimize the adverse effects upon shape control that are associated with prior art single-turn inductors.

It is apparent that there has been provided in accordance with this invention a variable-pitch inductor for use in electromagnetic casting apparatus and processes for electromagnetic casting, which fully satisfy the objects, means, and advantages as set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the broad scope and spirit of the appended claims.

All prior art disclosed and discussed herein is hereby incorporated by reference.

What is claimed is:

1. In an apparatus for electromagnetically casting molten material into an ingot of desired shape comprising:

means for receiving and electromagnetically containing and forming said molten material into said ingot, the improvement wherein:

said means for receiving and electromagnetically containing and forming said molten material comprises a variable-pitch multi-turn inductor, said inductor comprising at least three individual turns arranged in a stacked relationship with each turn being oriented parallel to each other such that the center line through the mid-point of each turn is substantially perpendicular to the longitudinal axis through the inductor in the direction of casting;

said at least three individual turns further arranged with the pitch between said turns having a value of $a_{(z)}$ defined substantially by the formula:

$$a_{(z)} = a_o / \sqrt{\frac{h-z}{h}}$$

wherein $a_{(z)}$ = the pitch or spacing between inductor turns at a height z above the solidification interface $a_o$ = the pitch or spacing between inductor turns at the solidification interface h = the total molten material head z = the height above the solidification interface;

said individual turns being electrically connected in series and being spaced apart from each other by individual insulating spacers whereby an electromagnetic field is generated being substantially uniform in a transverse direction and non-uniform in a longitudinal direction.

2. In an apparatus for electromagnetically casting molten material into an ingot of desired shape comprising:

means for receiving and electromagnetically containing and forming said molten material into said ingot, the improvement wherein:

said means for receiving and electromagnetically containing and forming said molten material comprising a variable-pitch multi-turn inductor;

said inductor comprising at least three individual turns arranged in a stacked relationship with each turn being oriented parallel to each other such that the center line through the mid-point of each turn is substantially perpendicular to the longitudinal axis through the inductor in the direction of casting;

said at least three individual turns further arranged with the pitch between said turns having a value of $a_{(z)}$ defined substantially by the formula:

$$a_{(z)} = a_o/\sqrt{\frac{h-z}{h}}$$

wherein $a_{(z)}$ = the pitch or spacing between inductor turns at a height z above the solidification interface $a_o$ = the pitch or spacing between inductor turns at the solidification interface h = the total molten material head z = the height above the solidification interface;

said turns being electrically connected in series and being spaced apart from each other by individual spacers whereby an electromagnetic field is generated being substantially uniform in a transverse direction and nonuniform in a longitudinal direction; and wherein said individual turns are of different cross-sectional height.

3. In an apparatus for electromagnetically casting molten material into an ingot of desired shape comprising:

means for receiving and electromagnetically containing and forming said molten materials into said ingot, the improvement wherein:

said means for receiving and electromagnetically containing and forming said molten material comprising a variable-pitch multi-turn inductor;

said inductor comprising at least three individual turns arranged in a stacked relationship with each turn being oriented parallel to each other such that the center line through the mid-point of each turn is substantially perpendicular to the longitudinal axis through the inductor in the direction of casting;

said at least three individual turns further arranged with the pitch between said turns having a value of $a_{(z)}$ defined substantially by the formula:

$$a_{(z)} = a_o/\sqrt{\frac{h-z}{h}}$$

wherein $a_{(z)}$ = the pitch or spacing between inductor turns at a height z above the solidification interface $a_o$ = the pitch or spacing between inductor turns at the solidification interface h = the total molten material head z = the height above the solidification interface;

said individual turns being electrically connected in series and being spaced apart from each other by individual insulating spacers whereby an electromagnetic field is generated being substantially uniform in a transverse direction and non-uniform in a longitudinal direction; and wherein said individual spacers are of different cross-sectional height.

4. In an apparatus for electromagnetically casting molten material into an ingot of desired shape comprising:

means for receiving and electromagnetically containing and forming said molten materials into said ingot, the improvement wherein:

said means for receiving and electromagnetically containing and forming said molten material comprising a variable-pitch multi-turn inductor;

said inductor comprising at least three individual turns arranged in a stacked relationship with each turn being oriented parallel to each other such that the center line through the mid-point of each turn is substantially perpendicular to the longitudinal axis through the inductor in the direction of casting;

said at least three individual turns further arranged with the pitch between said turns having a value of $a_{(z)}$ defined substantially by the formula:

$$a_{(z)} = a_o/\sqrt{\frac{h-z}{h}}$$

wherein $a_{(z)}$ = the pitch or spacing between inductor turns at a height z above the solidification interface $a_o$ = the pitch or spacing between inductor turns at the solidification interface h = the total molten material head z = the height above the solidification interface;

said individual turns being electrically connected in series and being spaced apart from each other by individual insulating spacers whereby an electromagnetic field is generated being substantially uniform in a transverse direction and non-uniform in a longitudinal direction; and wherein said individual turns and said individual spacers are of different cross-sectional height.

5. The apparatus as in claim 1, 2, 3, or 4 wherein said variable-pitch multi-turn inductor defines a casting zone having a molten material input end and a solidifying ingot output end such that said pitch increases from said output end towards said input end, whereby the electromagnetic field generated by said inductor is characterized by a gradually diminishing flux density from said output end towards said input end.

6. The apparatus as in claim 5 wherein said individual turns are of increasing height toward said input end of said casting zone.

7. The apparatus as in claim 5 wherein said individual spacers are of increasing height toward said input end of said casting zone.

8. The apparatus as in claim 5 wherein said individual turns and individual spacers are of increasing height toward said input end of said casting zone.

9. The apparatus as in claim 1, 2, 3, or 4 wherein the turns of said inductor have internal passages for passage of a cooling fluid.

10. The apparatus as in claim 1, 2, 3, or 4 wherein said spacers are constructed of a thermo-setting high temperature plastic material.

11. The apparatus as in claim 9 wherein said turns of said inductor are constructed of rectangular cross section copper tube.

12. The apparatus as in claim 9 wherein said turns are constructed of copper tube of round cross section.

* * * * *